United States Patent [19]

Kuna et al.

[11] 4,068,841

[45] Jan. 17, 1978

[54] ILLUSION APPARATUS

[75] Inventors: Wayne A. Kuna, Oak Park; Ralph J. Kulesza, Chicago; Gordon A. Barlow, Evanston, all of Ill.

[73] Assignee: Marvin Glass & Associates, Chicago, Ill.

[21] Appl. No.: 657,643

[22] Filed: Feb. 12, 1976

[51] Int. Cl.[2] ..... A63J 5/00

[52] U.S. Cl. ..... 272/8 R; 46/13

[58] Field of Search ..... 272/9, 11, 23, 21, 8 R, 272/8 N, 8 D, 12, 22, 25, 27 B; 46/13, 19, 126, 35, 36, 37; 40/16, 16.2, 16.4, 16.6, 62, 78, 65

[56] References Cited

U.S. PATENT DOCUMENTS

| | | | |
|---|---|---|---|
| 47,552 | 5/1865 | Ketcham | 272/9 |
| 1,040,616 | 10/1912 | Burke | 46/13 |
| 1,523,282 | 1/1925 | Powers | 46/13 |
| 1,995,463 | 3/1935 | Young | 46/36 X |
| 2,034,407 | 3/1936 | Massey | 272/9 |
| 2,314,629 | 3/1943 | Pickley | 46/36 X |
| 2,620,591 | 12/1952 | Scola | 46/13 |
| 3,989,251 | 11/1976 | Barlow | 272/8 R X |

FOREIGN PATENT DOCUMENTS

| | | | |
|---|---|---|---|
| 431,423 | 7/1926 | Germany | 272/25 |
| 89,965 | 7/1921 | Switzerland | 46/13 |
| 106,681 | 6/1917 | United Kingdom | 40/65 |

*Primary Examiner*—William H. Grieb
*Assistant Examiner*—Arnold W. Kramer
*Attorney, Agent, or Firm*—Mason, Kolehmainen, Rathburn & Wyss

[57] ABSTRACT

An illusion performing apparatus including a performing stage having a base, an upright rectangular open support frame, and a plurality of removable support walls for interchangeably mounting in the opening of the frame. Each of the support walls includes a plurality of illusion devices. A first support wall provides illusion devices for performing the illusion of making a figure disappear, performing the illusion of making a figure turn into a skeleton, and a mindreading magic act including a plurality of cards having identifiable indicia on each of the cards. A second support wall includes an illusion device for performing an illusion of separating a figure toy into a plurality of parts, causing a container filled with a fluent material to appear, and causing a substantially large figure toy such as an animal to disappear. A third support wall includes illusion devices for performing the illusion of passing knives through a figure toy, performing the illusion of causing a figure toy to change characteristics, for example from a woman to a man, and performing the illusion of sawing a body in two and then recombining the body of the figure toy. A magic wand and handkerchief or scarf secured thereto is provided for use by the performer in concealing the operation of the various illusion devices mounted on the support walls. Several of the above described illusion devices have manually manipulatable portions extending behind the support wall which may be actuated by the user while being concealed from the observer or audience.

3 Claims, 15 Drawing Figures

28
22
40
16
26
18
20
12

22
24
3
28
40
20
18
26
16
40
28
3
18
20

10
14

Fig 13
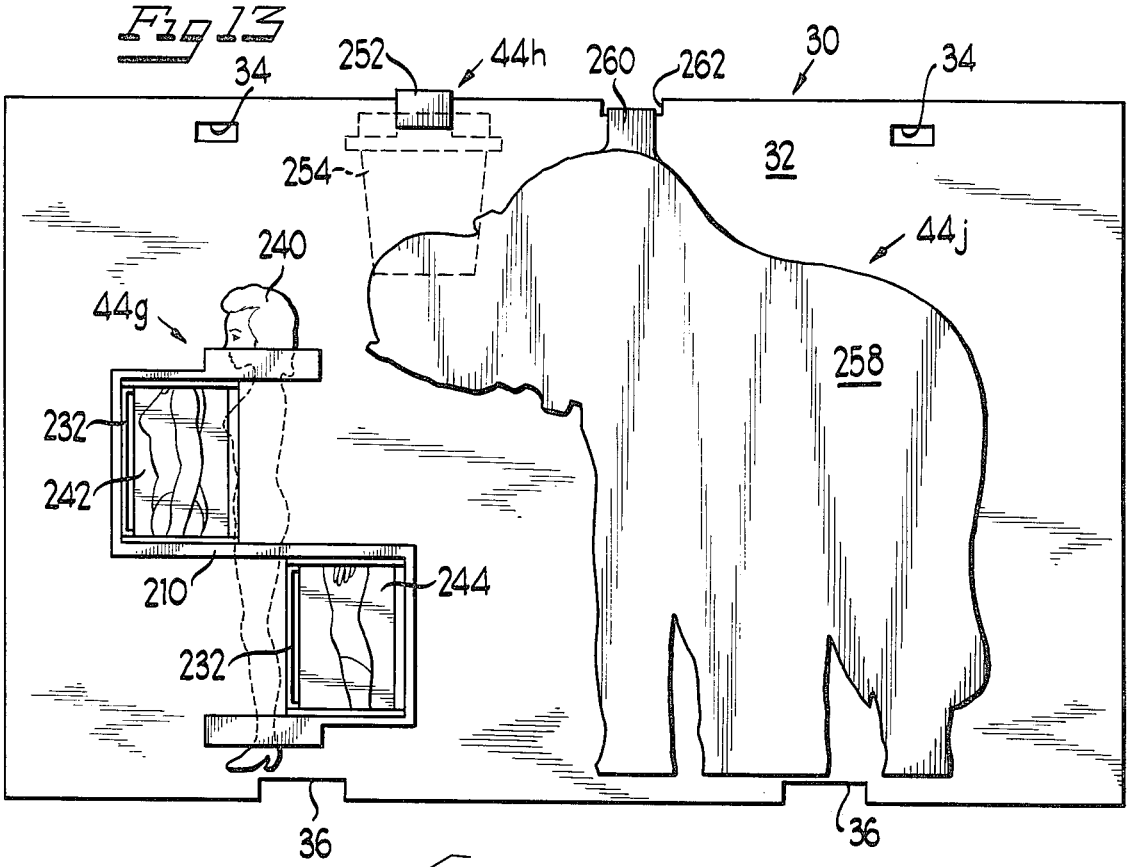
Fig 14
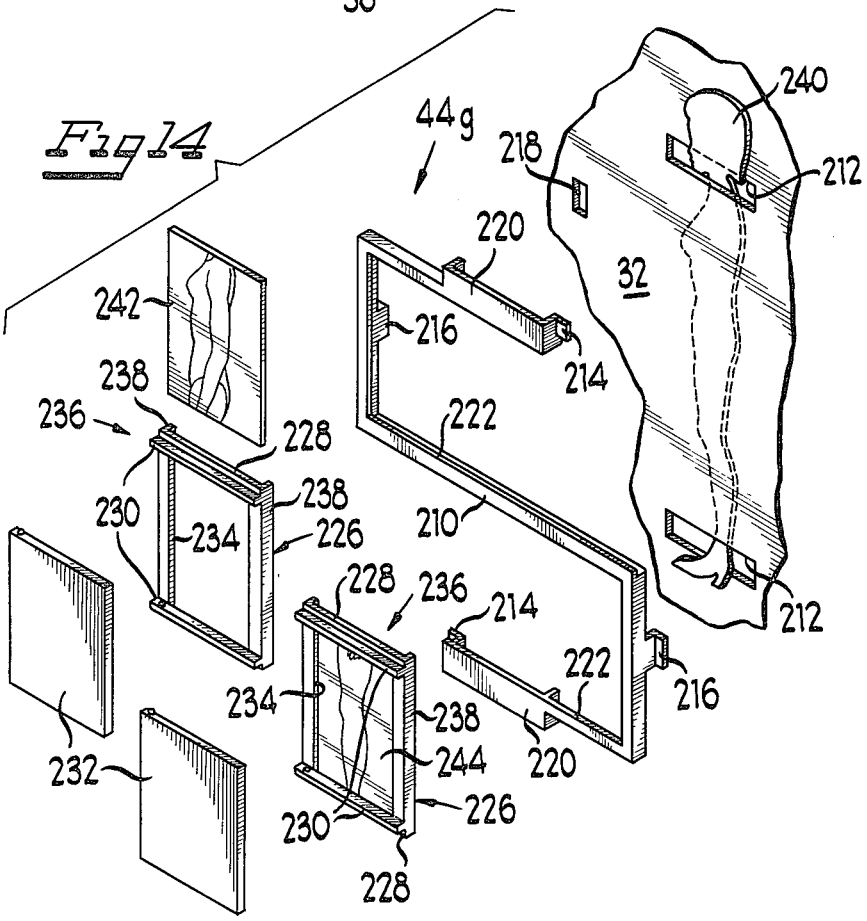
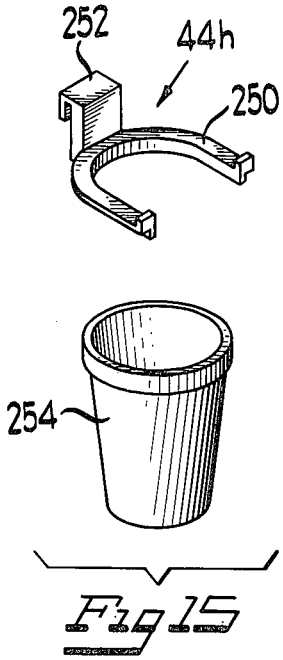
Fig 15

ILLUSION APPARATUS

BACKGROUND OF THE INVENTION

The present invention relates to an illusion apparatus and in particular to a miniature stage including a plurality of devices for performing illusions or magic tricks.

SUMMARY OF THE INVENTION

An object of the present invention is to provide a new and entertaining illusion performing apparatus including a plurality of magic trick accessories.

This and other objects of the invention are accomplished in one embodiment currently contemplated which provides a miniature stage having a base portion, a rectangular upstanding open frame mounted on the base and a plurality of interchangeable support walls supportable by the frame in the opening thereof. Each of the support walls includes a plurality of separate illusion-performing devices. A first wall includes an illusion device for making a figure disappear, an illusion device for changing a body into a skeleton, and a mind-reading magic trick. A second support wall includes an illusion device for severing the body of a figure toy into four parts, an illusion device for making a container of fluid material appear in the hand of the user, and an illusion device for making a figure toy disappear. A third support wall includes an illusion device for passing articles through the body of a figure toy, an illusion device for changing the physical characteristics of a figure toy, and an illusion device for apparently sawing the body of a figure toy into two portions.

Other objects, features and advantages of the invention will be apparent from the following detailed description taken in connection with the accompanying drawings.

BRIEF DESCRIPTION OF THE DRAWINGS

FIG. 13 is a front elevational view of another support wall showing three illusion devices;

FIG. 14 is an exploded perspective view of one of the illusion devices shown in FIG. 13; and FIG. 15 is an exploded perspective view of another of the illusion devices shown in FIG. 13.

DESCRIPTION OF THE PREFERRED EMBODIMENT

Figures 1, 2, 3:
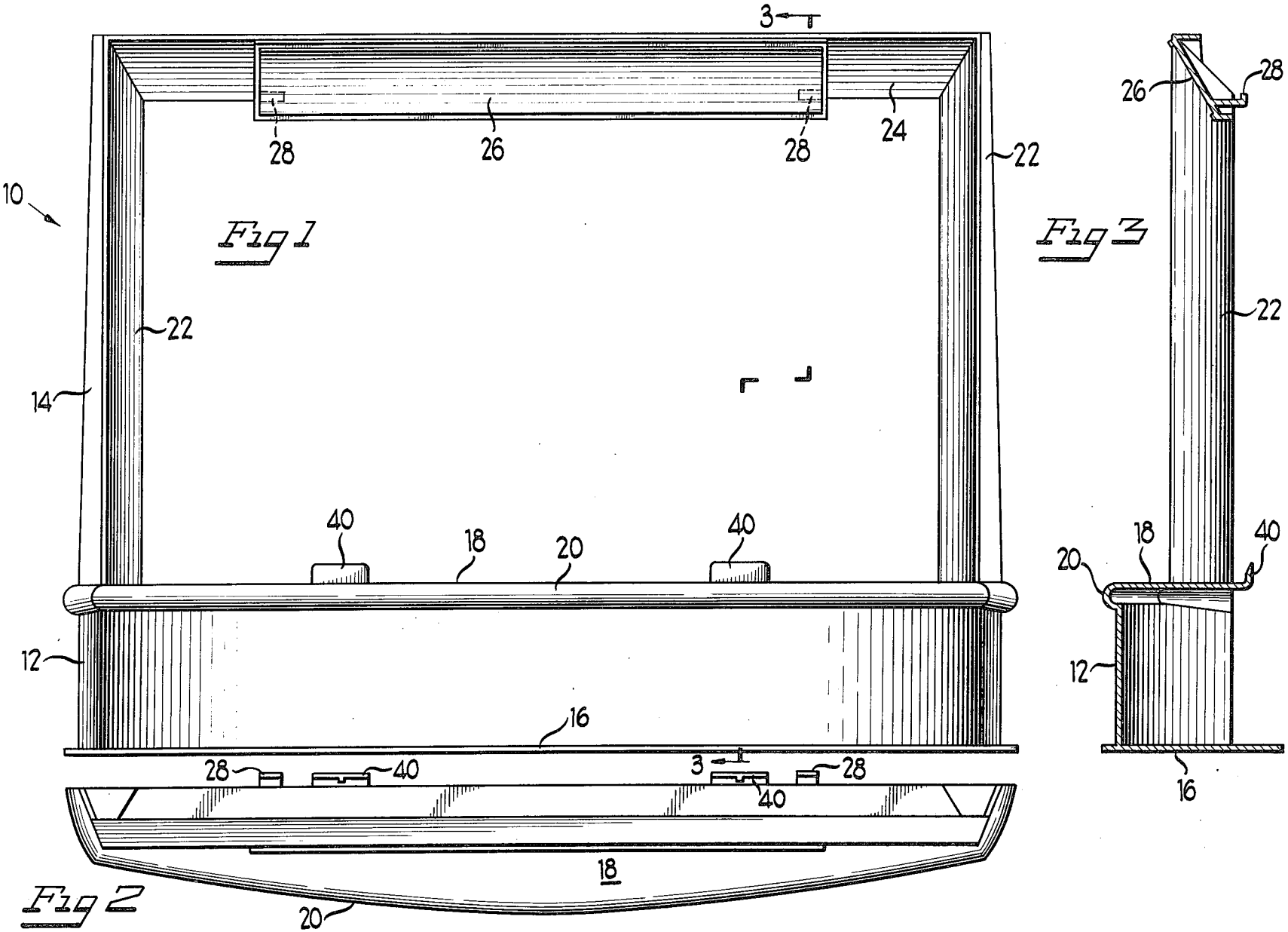
FIG. 1 is a front elevational view of the frame of the illusion apparatus of the present invention.
FIG. 2 is a top plan view of the illusion apparatus frame of FIG. 1.
FIG. 3 is a vertical section of the frame taken generally along line 3—3 of FIG. 1.

An illusion apparatus, generally designated 10, made in accordance with the concept of the present invention is shown in FIG. 1. The apparatus 10 is in the form and shape of a miniature stage having a base portion 12 and an upstanding frame portion 14. The base 12 has a bottom wall 16 which supports the apparatus on a suitable supporting surface. A top wall 18 of the base 12 defines the floor or stage portion and includes a generally arcuately shaped front perimeter 20. The frame 14 comprises a pair of generally vertical side supports 22 and a top cross-connecting member 24 between the upper end thereof. A generally flat canted surface 26 on the cross member 24 provides a mounting area for a sign or the like.

Figure 4:
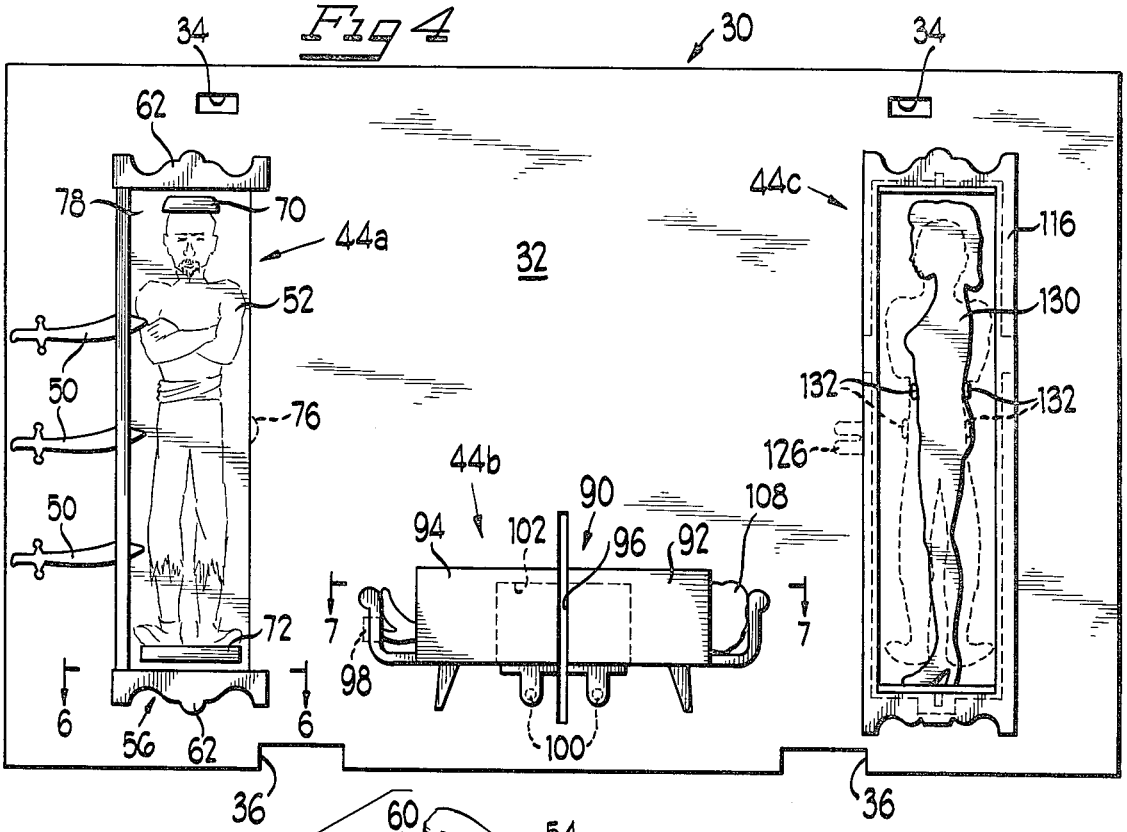
FIG. 4 is a front plan view of one of the support walls showing three of the contemplated illusion devices.
Figure 5:
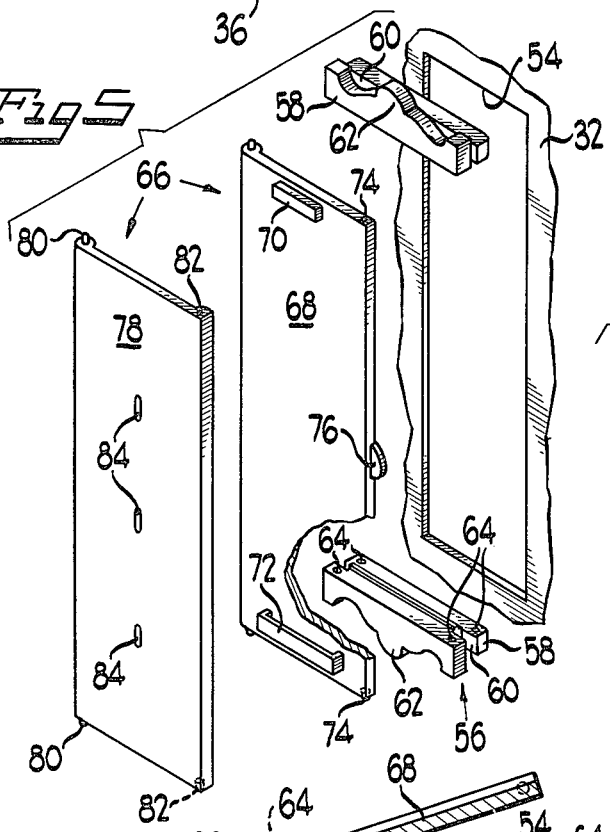
FIG. 5 is an exploded, perspective view of one of the illusion devices shown in FIG. 4.
Figure 9:
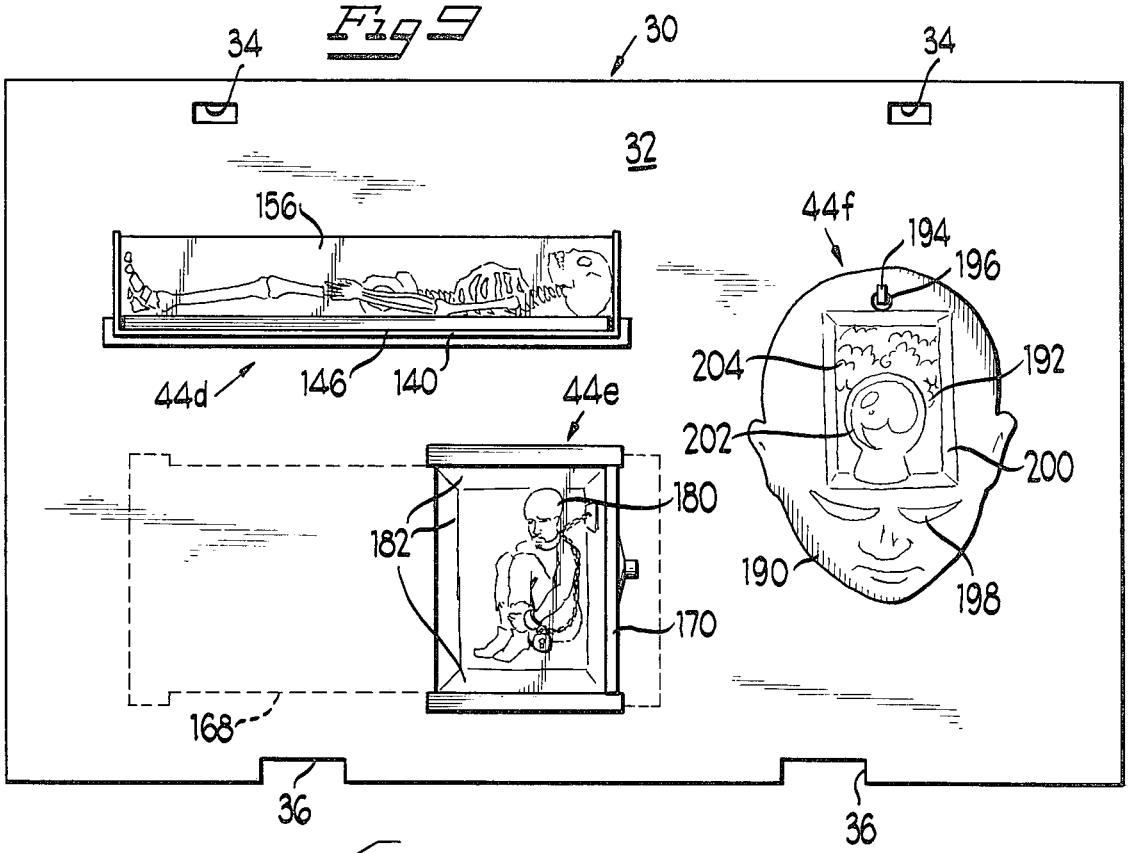
FIG. 9 is a front elevational view of another support wall showing three illusion devices.

Referring particularly to FIGS. 2 and 3, the stage portion includes a pair of rearwardly directed tabs 28 on the upper cross member 24 for supporting a plurality of backdrops or support walls generally designated 30 in FIGS. 4, 9 and 13. Each of the support walls 30 include a generally flat plate 32 made of plastic, cardboard, or the like, having a pair of spaced, generally rectangular apertures 34 near the top edge thereof for engaging the tabs 28 to mount the support walls on the stage frame 14. A similar pair of generally rectangular cutouts 36 at the bottom edge of each support wall 30 are aligned and maintained in engagement with the frame 14 by a pair of rearwardly and upwardly directed tabs 40 secured to or formed integrally with the floor 18 of the stage. All of the support walls 30 are interchangeably mountable in the tabs 28 and 40 so that any of the support walls can be used with the stage 10. The upper tabs 28 are hidden from view of an observer by the flat surface 26 while the lower tabs 40 are covered and concealed from view by the support wall placed thereon.

A plurality of illusion devices, generally designated **44*a* through 44*j* are provided on each of the support walls 30** and will be discussed separately in the following description thereof.

Referring to the left of FIG. 4, a first illusion device **44*a* is provided for performing the illusion of passing a plurality of articles, such as knives 50 through a figure toy 52, or the like. This illusion device includes a generally rectangular aperture 54 in the support wall 32 which mounts a frame, generally designated 56. The frame 56 includes an upper and lower bracket portion 58 which mounts in the aperture 54. A channel 60 in the center of each bracket portion 58 slides over the upper and lower edges of the aperture 54. The front exposed side of each bracket portion 58 may include a decorative molding 62. Four apertures or holes 64 at the respective corners of each bracket portion 58 are provided for pivotally mounting a pair of doors 66 and maintaining the doors in a closed position. A rear door 68 is pivotally mounted by the frame 56 on the back or rearward side of the support wall 32. The rear door 68 includes an upper and lower channel 70 and 72, respectively, for mounting a two-dimensional illusion card in the shape of a figure toy 52. Small detents 74 at the free ends of the door 68 seat within the appropriate apertures 64 to maintain the door in a closed position. The rear door includes a tab 76** which facilitates manual opening of the door by the user.

A front door 78 is pivotally mounted by a pair of pins 80 on a front side of support wall 32 directly in front of the aperture 54. Similar detents 82 maintain the door in a closed position. When the door 78 is opened, an observer in front of the stage can see through the aperture 54 to see the figure toy 52 mounted on the rear door when the rear door is in its closed position as shown in FIG. 4. The plurality of knives 50 are insertable through apertures 84 in the front door as shown in FIG. 4. To perform the illusion of piercing the figure toy with the knives 50, the user mounts the figure toy 52 onto the rear door which is clearly visible to the observer. The front door 78 then is closed and out of view of the observer, the rear door is opened to provide an open path through the aperture 54. The knives 50 then are inserted through the apertures 84 to give the appearance of puncturing or stabbing the figure toy 52 to the audience. The front door then is opened simultaneously as the rear door is closed and while the knives 50 have appeared to pierce the figure toy, the figure toy is shown to the observer to be unpunctured.

Figure 7:
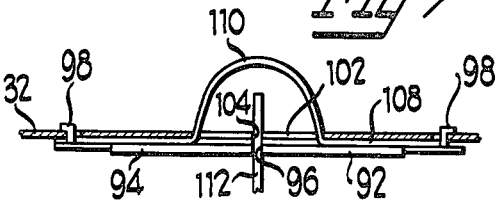
FIG. 7 is a horizontal section of another illusion device taken generally along line 7—7 of FIG. 4.

Another illusion-performing device **44*b* is shown generally in the center of FIG. 4 and in FIG. 7. This illusion device permits the user to perform an act in which it appears that he has cut a figure toy in half and then reunited the figure toy. The illusion device 44*b* includes a frame generally designated 90 which is mounted on the support wall 32. The frame includes two portions 92 and 94 which, when mounted on the wall 32, are spaced apart slightly to define a slot 96 therebetween. The frame members 92 and 94 are mounted by a pair of rearwardly directed tabs 98 through apertures in the wall 32 and by a pair of pins 100 shown in phantom. The frame portions 92 and 94 conceal a generally rectangular aperture 102 in the support wall 32. The aperture 102 includes an upwardly and downwardly directed slot portion 104 contiguous therewith which appears to elongate the slot 96 defined by the frame portions 92 and 94. To perform this trick, an illusion card 108 in the form of a figure toy is placed in the frame 90. However, the horizontal length of the card 108, as shown in FIG. 4, is slightly larger than the length of the frame so that when placed therein the figure toy 108 must be collapsed slightly causing a bowed portion 110 to flex outwardly through the aperture 102 behind the support wall 32. A miniature saw 112 is inserted through the slots 104 and 96 and moved downwardly while reciprocated in a sawing motion so as to appear to the observer that the saw is slicing the figure toy 108 into two portions. Since the figure toy is bowed in the area of the aperture 102, the saw will not contact and cut the figure toy into two portions so that it later can be removed from the illusion device 44*b***, as one piece.

Figure 8:
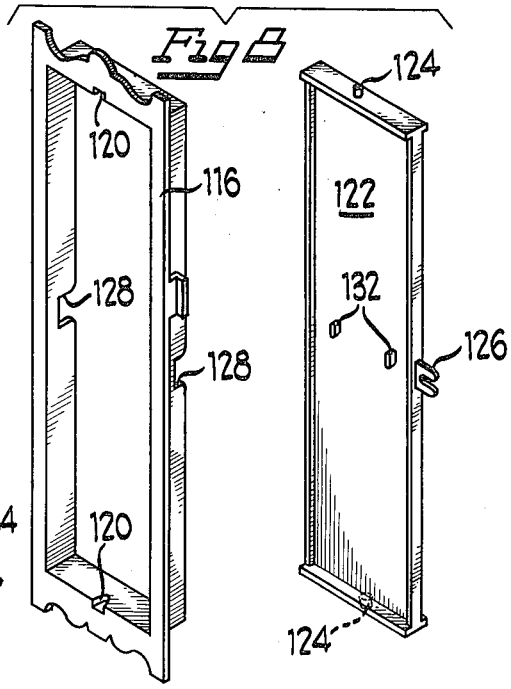
FIG. 8 is another exploded, perspective view of another illusion device as shown in FIG. 4.
Figure 6:
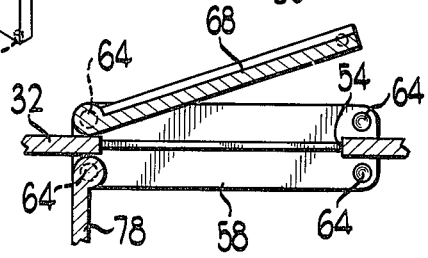
FIG. 6 is a horizontal section of one of the illusion devices taken generally along line 6—6 of FIG. 4.
Figure 12:
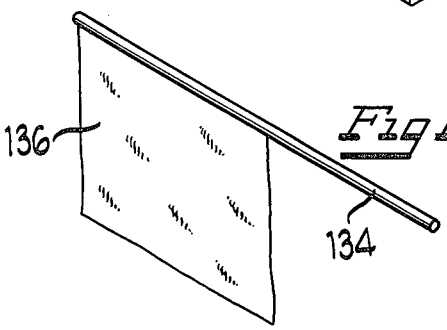
FIG. 12 is a perspective view, on a reduced scale, of a magic wand and attached magic scarf for use with the present invention.

Another illusion device **44*c* is shown at the right of FIG. 4, and in FIG. 8. In this illusion device, a frame member 116 is mounted within a rectangular aperture formed in the wall 32. The frame includes a pair of notches 120 along its generally vertical axis, at the ends of the frame, for pivotally mounting a rotatable door 122 by a pair of pins 124 in the slots 120. A tab 126 on one side of the door 122 permits the door to be rotated manually 180° as the tab fits within slots 128 formed on the frame so that either side of the door 122 can be seen by an observer through the aperture in the wall 32. An illusion card 130 in the shape of a figure toy is mounted on either side of the door 122 by a pair of friction pins 132. Each of the figure toys have a different configuration, such as a shape of a woman as shown in solid lines in FIG. 4, and a man as shown in phantom of FIG. 4. A magic wand 134 and a handkerchief or scarf 136 (FIG. 12) are utilized during the performance of this illusion. The door 122 is set with one of the figure toys being visible to the audience while the other figure toy, on the back of the door, is concealed. The door then is covered with the magic wand 134 and scarf 136 while the door 122 is manually rotated by the user. The scarf 136 then is lifted out of the way so that the observer can see the change in shape of the figure toy 130**.

FIG. 9 shows a second support wall 32 including the illusion devices **44*d*, 44*e* and 44*f***.

Figure 10:
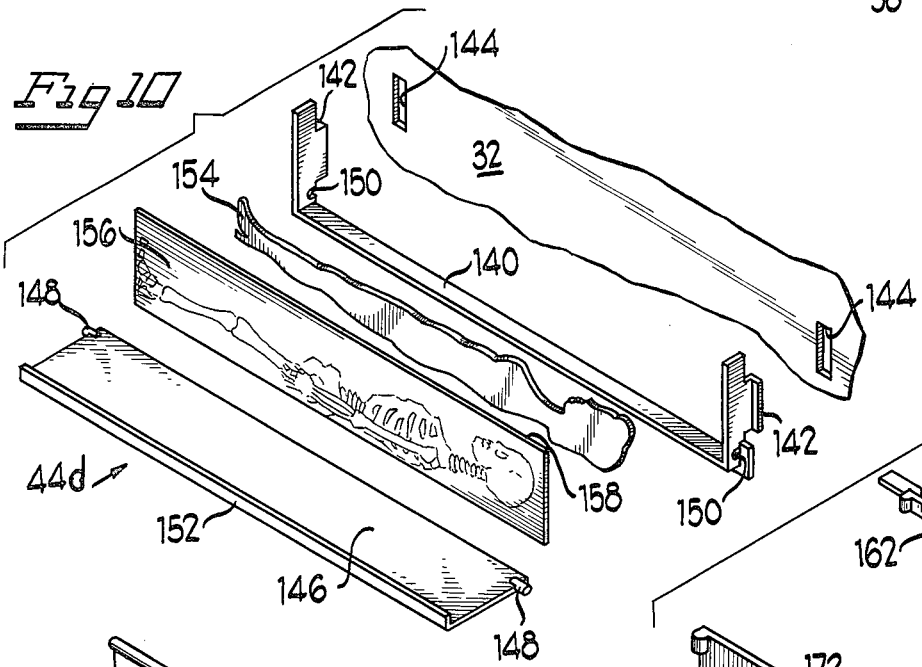
FIG. 10 is an exploded perspective view of one of the illusion devices as shown in FIG. 9.

The illusion device **44*d* is shown in perspective in FIG. 10. This device includes a generally U-shaped frame 140 which is mounted by a pair of tabs 142 to the support wall 32 by a pair of rectangular apertures 144 therein. A pivotally mounted front door 146 is mounted to the frame so as to open about a horizontal axis defined by a pair of pins 148 on the door which engage a complementary pair of recesses 150 on the frame. An illusion card engaging portion or lip 152 extends rearwardly from the front surface of the door 146. To perform this trick, a pair of illusion cards 154 and 156 are used. The illusion card 156 carries indicia representing a skeleton while the illusion card 154 is cut in the silhouette of a woman. The illusion card 156 is placed on the door 146 when in the open position in engagement with the lip 152 out of the view of the audience. The silhouette card 154 is placed on the frame 140 in view of the audience. The door 146 is then pivoted upwardly which pivots the illusion card 156 in front of the silhouette card 154. Subsequent opening of the door 146 permits the audience to view the skeleton on the illusion card 156** so that it appears that the woman has been transformed into a skeleton.

Figure 11:
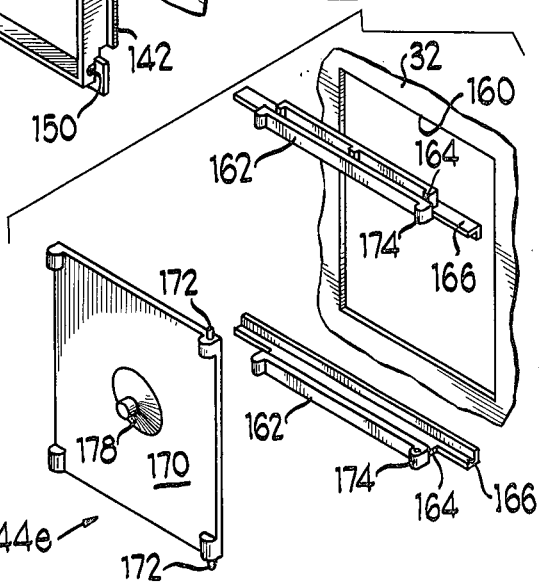
FIG. 11 is an exploded perspective view of another of the illusion devices shown in FIG. 9.

Another illusion apparatus, generally designated **44*e*, is shown generally at the bottom of FIG. 9 and in perspective in FIG. 11. This device 44*e* includes a rectangular aperture 160 in the support wall 32 which is fitted with an upper and lower frame portion 162. The frame portions include a slot 164 for engaging the edge of the aperture 160 and a pair of rear guide rails 166 which support an illusion card 168, shown in phantom in FIG. 9, for horizontal movement relative to the guide rails 166. A door 170 is pivotally mounted by a pair of pins 172 in a pair of apertures 174 in the frame members 162 to close the aperture 160 in the support wall 32. A simulated combination lock dial 178 is provided on the front surface of the door 170 to make the device look somewhat similar to a safe. The illusion card 168 includes, in position on the righthand side as shown in FIG. 9, indicia showing a figure 180 being chained to the interior walls 182 of the safe. At a second position, to the left of FIG. 180, indicia is imprinted on the card showing the interior of an empty safe. To perform the illusion with this device 44*e*, the user opens the door 170 to permit an observer to view the figure 180 within the safe. Then, with one hand the user closes the door of the safe 170, and with the other hand moves the card 186** to its second position and then opens the door of the safe to move the figure so as to disappear from within the safe.

An illusion device **44*f* is shown in the right of FIG. 9. This device permits the user to perform the illusion of mindreading. The device includes a plurality of cards 190 in the shape of a figure head each of which carries substantially identical indicia on the front sides thereof. As shown, the cards 190 are mounted onto the front of the wall 32 on a forwardly directed post 194 through apertures 196 in each card. A colored dot is provided on the backside of each card 190 (not shown) such that each card carries a dot of a different color. The indicia 192 on the front of each card includes the base of a figure toy 198, a rectangular frame 200, a crystal ball on a stand 202 and a cloud pattern 204 behind the crystal ball 202**. A letter representing the first letter in the word corresponding to the color of the dot on the back of the respective card is camouflaged within the cloud pattern so as to provide a key which is known only to the user of the device. To perform the mindreading illusion, an observer chooses one of the cards from the stack and looks at the back of the card to identify the color of the dot while the front indicia-carrying portion of the card is facing the user. Since the user is aware of the indicia key, by visually observing the front of the card, he will know what color dot appears on the back of the card. Thereafter, he can orally convey the message to the viewers thereby appearing to "read the mind" of the observer looking at the colored dot.

A third support wall 32 is shown in FIG. 13 to include the illusion devices **44*g*, 44*h* and 44*j*. The illusion device 44*g* also is shown in FIG. 14. This device permits the user to apparently sever the body of a figure into four separate and disconnected parts and then reassemble the parts to a unitary figure. The illusion device 44*g* includes a generally S-shaped frame 210. The frame 210 is positioned upon the support wall 32 in front of a pair of generally rectangular, horizontal slots 212. A pair of tabs 214 engage the ends of the slots 212 and a second pair of tabs 216 engage a pair of tab slots 218 to secure the frame 210 to the support wall 32. The frame 210 includes two enlarged, rectangular portions 220 which mount in front of and conceal the apertures 212. The frame 210 includes a front peripheral flange 222 about the generally convexed portions of the S-curve to define a sliding guide surface for a pair of slide members, generally designated 226, shown in front of the frame member 210 in FIG. 14. The slide members 226 each include a pair of guide rails 228 on the top and bottom edges thereof to maintain the slide members 226 behind the respective flanges 222 on the upper and lower portions of the frame 210. Each of the slide members 226 also includes a pair of forwardly directed flanges 230 which facilitate the manual movement of the slide members 226 within the frame 210. A pivotally mounted door 232 is mounted on each slide member 226 between the flanges 230 for opening and closing an aperture 234 defined therein. A card receiving means, generally designated 236, is defined on the rearward side of each slide member 226 by three rearwardly directed flanges 238. In order to perform the illusion of dismembering the figure toys, an illusion card 240 in the shape of a figure toy is inserted from the front through the upper aperture 212 behind the support wall 32 and then out again through the lower aperture 212 so that the head and feet of the figure toy are visible as shown in FIG. 14. A second pair of illusion cards 242 and 244 carrying indicia thereon representing a portion of the illusion card 240 are inserted within the slide members 226 while the slide members are in a generally vertical alignment. When the doors 232 on the slide members are in their open position, a viewer looking at the support wall 32 will see a complete figure toy not realizing that he is viewing the two cards 242 and 244 in addition to the figure toy card 240. The front doors 232 are then closed while the upper slide member 226 is moved to the left and the lower slide member 226 is moved to the right. Thereafter, the doors 232 are opened to expose the dismembered figure toy 240 to the observer as shown in FIG. 13. Subsequent closing of the doors and vertically aligning of the slide members permits the user to remove the unitary figure toy 240** to thus complete the illusion.

Another illusion device **44*h* is shown in the top of FIG. 13 and in FIG. 15. This device, 44*h*, includes a yoke 250 which is mounted by a hook 252 to the top edge of the support wall 32. The yoke 250 will removably support a glass or other container 254 for easy access to the user behind th wall 32 as shown in phantom in FIG. 13. The container 254 may be filled with water or other suitable material so that the user, by covering the stage with the magic scarf 236 can make the container 254** "appear" from nowhere by manually lifting it over the stage while disguising his movements with the scarf.

Another illusion device **44*j* is shown at the right of FIG. 13. This device includes a substantially larger figure toy such as the elephant 258 which is connected to a tab 260 which extends over of and in back of the support wall 32 through a small cutout 262 therein. Again, by hiding the front of the stage by the scarf 136, the user can make the elephant appear to disappear by manually grasping the tab and lifting the figure toy 258** simultaneously with the scarf.

Note that in both of the last two mentioned illusion devices **44*h* and 44*j*, the hook 252 and tab 260 are hidden from the view of the observer by the top cross member 24 of the frame 14**. In this manner, it is not obvious to the observer how the illusions are being performed.

As described above, many of the illusion devices are operated manually from behind the particular support wall 32 positioned on the stage so as to conceal the movements of the user or "magician." Another of the devices, the magic wand 134 and scarf 136 can be utilized to disguise the movements of the user while distracting the audience. While with the magic stage 10 as shown and described with reference to the above drawings is capable of performing at least nine individual illusions, it is contemplated that many more such illusions could be devised and utilized without departing from the spirit of the present invention. Therefore, the foregoing detailed description has been given for clearness of understanding only and no unnecessary limitations should be understood therefrom since some modifications will be obvious to those skilled in the art.

We claim:

1. An illusion performing apparatus, comprising:

a base;

a generally vertical support wall including an aperture therein having a front side facing an observer;

a substantially flexible illusion card of predetermined length;

frame means mounted on said support wall having a portion extending over said front side of said aperture beyond the ends thereof and concealing a substantial portion of said aperture forming a vertical slot between the ends of the frame means in alignment with said aperture, the length of said frame means between its respective ends being smaller than the predetermined length of said illusion card so that the illusion card placed between said frame means and support wall is forced to bow through said aperture so that an article reciprocated in said slot although appearing to engage and cut the illusion card in two portions actually clears the surface of said bowed portion of the card to perform the illusion of cutting the card in two parts while actually not doing so.

2. The illusion performing apparatus of claim 1 wherein said illusion card is in the form and shape of a figure toy.

3. An illusion performing apparatus, comprising:

a base;

upstanding, generally rectangular frame means mounted on said base;

at least one generally rectangular support wall;

means for removably mounting said support wall on said rectangular frame means having a front side thereof facing an observer;

at least one illusion device mounted on said support wall having manually manipulatable portions thereof extending on at least the front side of said support wall so that an illusion may be performed by manually manipulating the illusion device in view of an observer to perform a trick wherein said upstanding support wall includes an aperture therein and said illusion device comprises a substantially flexible illusion card of predetermined length and frame means mounted on said support wall having a portion extending over the front side of said aperture beyond the ends thereof and concealing a substantial portion of said aperture and defining a vertical slot between the ends of the frame means in alignment with said aperture, the length of said frame means between its respective ends being smaller than the predetermined length of said illusion card so that the illusion card placed between said frame means and wall is forced to bow through said aperture so that an article passing through said slot appears to engage and cut the illusion card in two portions while clearing the surface of said bowed portion of the card to perform the illusion of cutting the card into two parts.

* * * * *